US008362372B2

(12) United States Patent
Kudrna et al.

(10) Patent No.: US 8,362,372 B2
(45) Date of Patent: Jan. 29, 2013

(54) ELECTRONIC MOBILE DEVICE SEAMLESS KEY/DISPLAY STRUCTURE

(75) Inventors: Paul John Kudrna, Naperville, IL (US); Michael Thomas Pope, Schaumburg, IL (US); James Nelson Aldrich, Arlington Heights, IL (US)

(73) Assignee: Research In Motion Limited, Waterloo, Ontario (CA)

( * ) Notice: Subject to any disclaimer, the term of this patent is extended or adjusted under 35 U.S.C. 154(b) by 208 days.

(21) Appl. No.: 13/021,010

(22) Filed: Feb. 4, 2011

(65) Prior Publication Data

US 2012/0199457 A1 Aug. 9, 2012

(51) Int. Cl.
*H01H 9/26* (2006.01)

(52) U.S. Cl. ..... 200/5 A

(58) Field of Classification Search ..... 200/510–514, 200/5 R, 6 R, 343, 339, 5 A, 6 A
See application file for complete search history.

(56) References Cited

U.S. PATENT DOCUMENTS

| | | | | |
|---|---|---|---|---|
| 5,504,286 | A | 4/1996 | Tsai | |
| 6,157,323 | A | 12/2000 | Tso et al. | |
| 7,131,780 | B2 | 11/2006 | Hirsch | |
| 7,217,898 | B2 | 5/2007 | Chien et al. | |
| 7,345,250 | B2 * | 3/2008 | Hakunti et al. | 200/5 A |
| 8,263,889 | B2 * | 9/2012 | Takahashi et al. | 200/512 |
| 2005/0277448 | A1 | 12/2005 | Castaneda et al. | |
| 2008/0060928 | A1 * | 3/2008 | Babella | 200/5 A |
| 2008/0237013 | A1 | 10/2008 | Shibuya et al. | |
| 2010/0078303 | A1 * | 4/2010 | Larsen et al. | 200/5 A |

FOREIGN PATENT DOCUMENTS

| | | | |
|---|---|---|---|
| EP | 1460821 | A2 | 9/2004 |
| WO | WO2008014110 | A2 | 1/2008 |

OTHER PUBLICATIONS

European Patent Office, Extended European Search Report, Application No. 11153449.1, Jun. 30, 2011.

BlackBerry—Storm 2 Touch Screen Phone—New Storm2 9550 Smartphone, http://us.blackberry.com/smartphones/blackberrystorm/, accessed Dec. 13, 2010.

BlackBerry—Curve 9300 Phone—New BlackBerry Curve 3G Smartphone, http://na.blackberry.com/eng/devices/blackberrycurve3G/, accessed Oct. 15, 2010.

BlackBerry Curve 9300 Keypad with Lens Removed (Picture), received Nov. 2, 2010.

U.S. Appl. No. 12/770,461, filed Apr. 29, 2010.

* cited by examiner

*Primary Examiner* — Edwin A. Leon
(74) *Attorney, Agent, or Firm* — Quarles & Brady LLP

(57) ABSTRACT

A key/display assembly includes first and second switches, a display module, and a lens is disposed adjacent the display module. The lens includes a first contact region, a second contact region, and an inner surface that supports a first foot between the first contact region and the second contact region. A first key is defined by the first switch and the first contact region and is actuated by deflecting the first contact region to actuate the first switch. A second key is defined by the second switch and the second contact region and is actuated by deflecting the second contact region to actuate the second switch. When actuating the first key, the first foot inhibits the second contact region from actuating the second switch. When actuating the second key, the first foot inhibits the first contact region from actuating the first switch.

20 Claims, 5 Drawing Sheets

ELECTRONIC MOBILE DEVICE SEAMLESS KEY/DISPLAY STRUCTURE

CROSS-REFERENCE TO RELATED APPLICATION

Not applicable.

STATEMENT OF FEDERALLY SPONSORED RESEARCH OR DEVELOPMENT

Not applicable.

BACKGROUND OF THE DISCLOSURE

The present disclosure generally relates to electronic mobile devices, and more particularly to key and display structures of electronic mobile devices.

In the design of electronic mobile devices, such as cellular phones and the like, there is an inclination to continuously improve aesthetic qualities. One manner for making such improvements involves designing smaller and/or thinner devices by using smaller and/or thinner components. Another manner for making aesthetic improvements includes using visually and/or tactilely pleasing individual components. One set of visually pleasing components includes an external lens that overlies a display module and defines, in part, one or more adjacent menu keys. This structure provides a smooth appearance with few, if any, breaks or discontinuities on the lens between the display module and the keys and between the keys themselves. As such, the keys appear to be part of a bezel structure that surrounds the display.

The above keys, while aesthetically pleasing, can be difficult for a user to manipulate. For example, if each key includes a mechanical switch (i.e., a dome switch) beneath the lens, the keys can be prone to "falsing". That is, keys may be inadvertently deflected and actuated when pressing a neighboring key due to the continuous structure of the lens. Slits or breaks can be provided between adjacent keys to prevent adjacent lens portions from unintentionally deflecting, although such a solution reduces the aesthetic appeal of the device.

Another solution to address key falsing involves using a touch-sensitive input device instead of mechanical switches. A touch-sensitive input can readily distinguish key presses between adjacent keys that are defined, in part, by a common lens structure. However, such touch-sensitive inputs typically do not provide tactile feedback to indicate to a user that a key has been successfully pressed.

DETAILED DESCRIPTION

According to some embodiments, a key/display assembly includes a first switch and a second switch, and a display module is disposed aside the first switch and the second switch. A lens is disposed adjacent the display module and has an inner surface facing the display module. The lens includes a first contact region adjacent the first switch and a second contact region adjacent the second switch. The inner surface supports a first foot disposed between the first contact region and the second contact region. A first key is defined by the first switch and the first contact region such that the first key is actuated by deflecting the first contact region to actuate the first switch. A second key is defined by the second switch and the second contact region such that the second key is actuated by deflecting the second contact region to actuate the second switch. When the first contact region deflects to actuate the first switch, the first foot inhibits the second contact region from actuating the second switch. When the second contact region deflects to actuate the second switch, the first foot inhibits the first contact region from actuating the first switch.

The teachings of the present disclosure relate generally to portable electronic devices, e.g., mobile communication devices such as pagers, cellular phones, global positioning system (GPS) navigation devices and other satellite navigation devices, smart phones, wireless organizers, wireless personal digital assistants (PDA), and tablet computers. The portable electronic devices could be devices without wireless communication capabilities such as PDAs, electronic gaming devices, digital photograph albums or picture frames, digital cameras, or digital video recorders. These examples are intended to be non-limiting. It is also possible that the teachings of the present disclosure could be applied to electronic devices other than handheld electronic devices, e.g., notebook computers.

Figure 1:
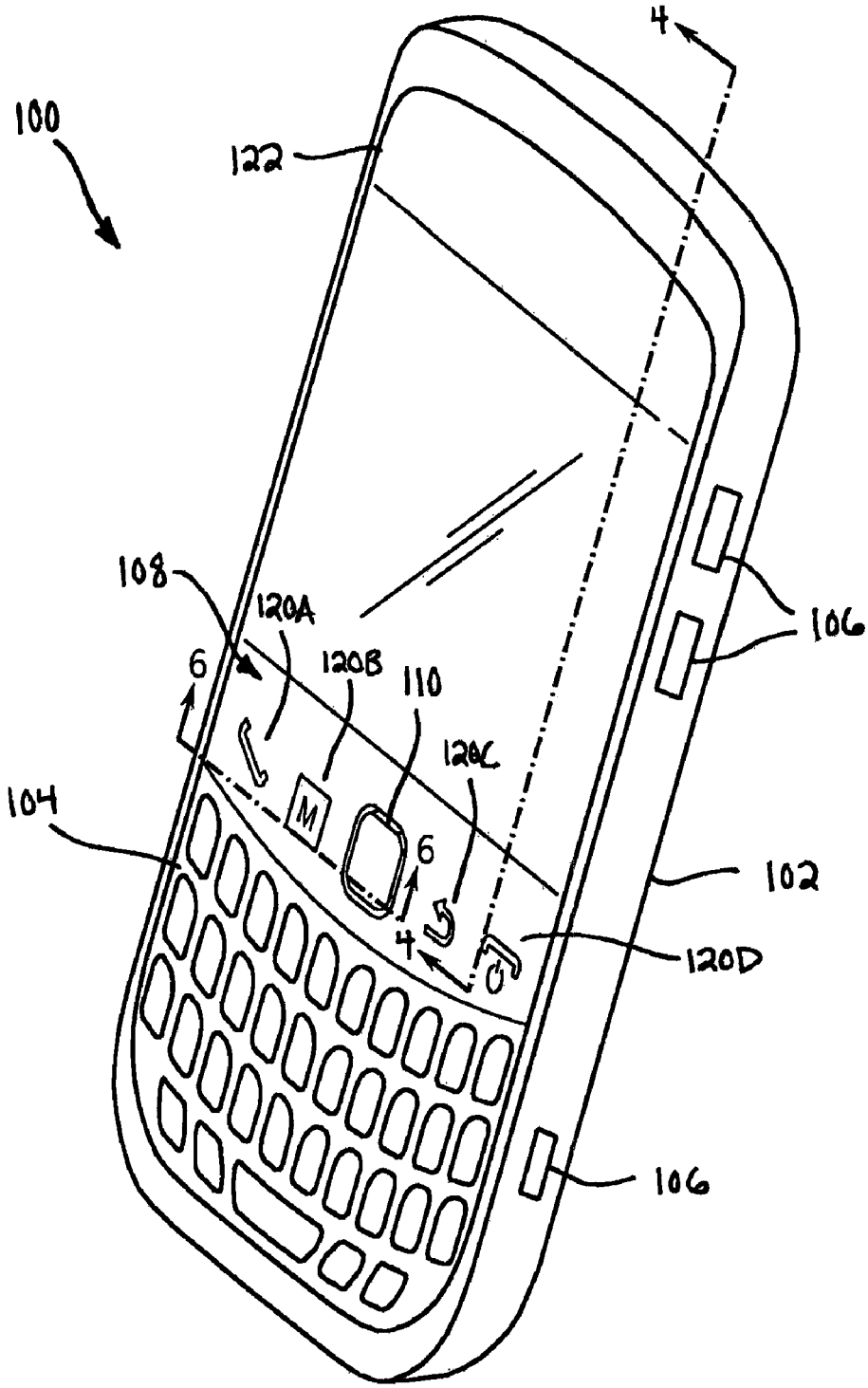
FIG. 1 is a front perspective view of an electronic mobile device including a key/display assembly according to the present disclosure.
Figure 2:
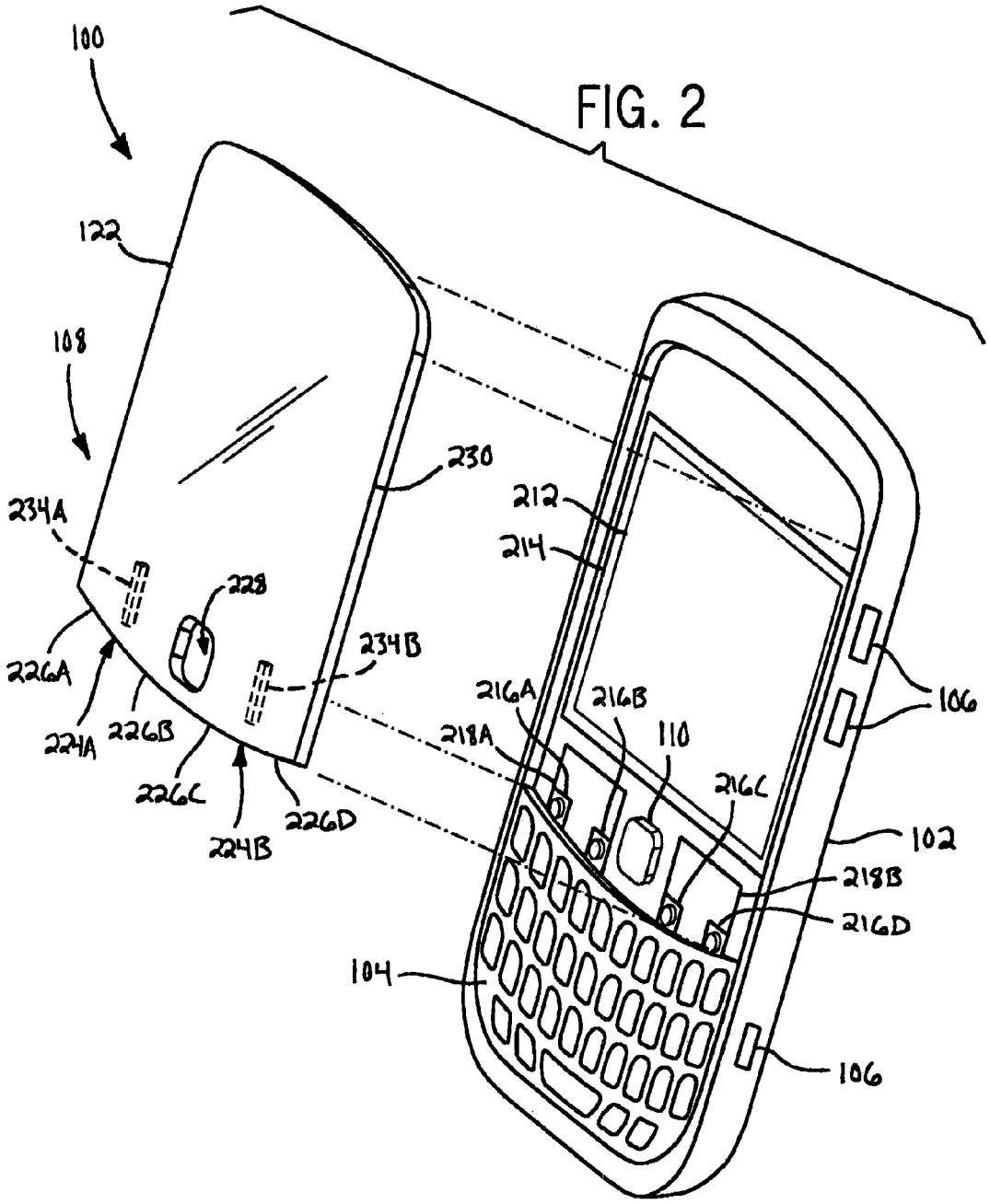
FIG. 2 is a partially exploded perspective view of the key/display assembly of FIG. 1.

Referring now to FIGS. 1-2, an electronic mobile device 100 according to the present disclosure generally includes a base 102 that houses various electronic components that control operation of the device, such as a microprocessor (not shown). The base 102 also supports a keypad or keyboard 104 on a front surface thereof. The keypad 104 includes keys that are actuatable by a user to provide inputs to the device 100 (e.g., to enter alphanumeric characters and the like). Sides of the base 102 may also support volume control or shortcut keys 106.

Above the keypad 104, the front surface of the base 102 supports a menu key/display assembly 108. As the name implies, the key/display assembly 108 is actuatable to perform various tasks (e.g., place and end voice calls, enter and exit device applications, and the like) and displays information to the user. Furthermore, with the exception of an optional input control (e.g., an optical trackpad 110 or the like), the key/display assembly has a generally continuous and aesthetically pleasing external appearance. The following paragraphs describe more specifically the structure of the key/display assembly 108 that provides this pleasing appearance in addition to improved key manipulability.

Still referring to FIGS. 1-2, the key/display assembly 108 includes a display module 212 (FIG. 2) supported by the base 102 and in communication with the microprocessor. The display module 212 displays information to the device user and, in some embodiments, is a liquid crystal display (LCD) module. Alternatively, the display module 212 may be another type of display device, such as an organic light emitting diode (OLED) module, a plasma display panel (PDP) module, or the like.

An open-rectangular gasket 214 (FIG. 2) surrounds the display module 212 on a side adjacent to the front surface of the base 102. In some embodiments, the gasket 214 comprises a semi-elastic polymer, such as silicone, although other similar materials may alternatively be used. Regardless of the specific material, the gasket 214 provides impact resistance for the display module 212. In addition, the gasket 214 also permits another component of the key/display assembly 108 to deflect as described in further detail below.

The key/display assembly 108 further includes a first switch 216A, a second switch 216B, a third switch 216C, and a fourth switch 216D (FIG. 2) supported by or adjacent to light guides 218A, 218B of the base 102. The switches 216A-D are disposed to the side of the display module 212 proximate the keypad 104, and the first and second switches 216A, 216B are disposed on the opposite side of the trackpad 110 than the third and fourth switches 216C, 216D. In some embodiments, the switches 216A-D are mechanical dome switches that "snap" when actuated by the user. Alternatively, the switches 216A-D may be any other type that provides tactile feedback to the user when actuated. Furthermore, it is appreciated that the device 100 is not limited to the four switches disclosed herein, and that fewer or more switches may be utilized to suit the application.

Each switch 216A-D defines, in part, a menu key of the key/display assembly 108 that is actuatable to perform one or more tasks. In particular, the first switch 216A defines, in part, a first key 120A (FIG. 1) that is actuatable, e.g., to place a voice call or display "recent calls" information. The second switch 216B defines, in part, a second key 120B that is actuatable, e.g., to display an application menu. The third switch 216C defines, in part, a third key 120C that serves as, e.g., a "back" or "escape" key. The fourth switch 216D defines, in part, a fourth key 120D that is actuatable, e.g., to end a voice call or serve as an on/off button for the electronic mobile device 100. However, it is recognized that the keys 120A-D are not limited to performing the above-identified functions.

The key/display assembly 108 further includes a lens 122 that overlies the display module 212, the compressible gasket 214, and the switches 216A-D. The lens 122 protects the components disposed therebelow and inhibits debris and other contaminants from entering the electronic mobile device 100. As such, the lens 122 may comprise molded materials such as polycarbonates, acrylics, thermoplastic elastomers (TPEs), and the like.

The lens 122 includes a first deflectable portion 224A and a second deflectable portion 224B that are cantilevered past the edge of the display module 212 and further define the menu keys 120A-D. In particular, the first deflectable portion 224A includes a first contact region 226A that further defines the first menu key 120A and a second contact region 226B that further defines the second menu key 120B. The second deflectable portion 224B includes a third contact region 226C that further defines the third menu key 120C and a fourth contact region 226D that further defines the fourth menu key 120D. As such, pressing and deflecting the first contact region 226A thereby actuates the first switch 216A to indicate to the microprocessor that the first key 120A has been pressed. Pressing and deflecting the second contact region 226B thereby actuates the second switch 216B to indicate that the second key 120B has been pressed. Pressing and deflecting the third contact region 226C thereby actuates the third switch 216C to indicate that the third key 120C has been pressed. Lastly, pressing and deflecting the fourth contact region 226D thereby actuates the fourth switch 216D to indicate that the fourth key 120D has been pressed.

In addition to protecting the components disposed therebelow and partially defining the menu keys 120A-D, the lens 122 is also generally continuous (i.e., lacking breaks and changes in thickness except for a passageway 228 through which the trackpad 110 extends) to provide an aesthetically pleasing appearance. In particular, the lens 122 is continuous between the first and second contact regions 226A and 226B and between the third and fourth contact regions 226C and 226D. Furthermore, the lens 122 is also continuous between a display region 230 that overlies the display module 212 and the contact regions 226A-D.

From the above, it should be apparent that deflecting one of the contact regions causes deflection of the adjacent contact region due to the continuous lens structure. For example, deflecting the first contact region 226A causes the second contact region 226B to deflect towards the second switch 216B. To prevent such switch falsing, an inner surface 332 (FIG. 3) of the lens 122 integrally supports a first foot 234A and a second foot 234B that inhibit the contact regions 226A-D from unintentionally actuating the switches 216A-D.

Figure 3:
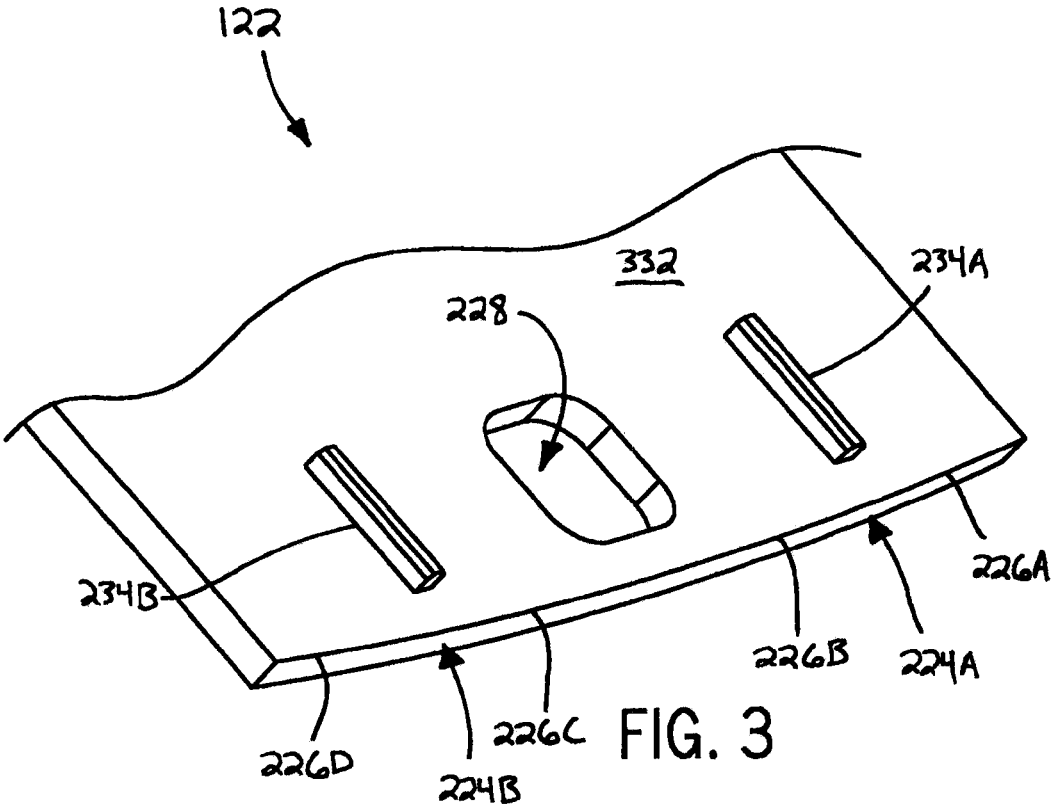
FIG. 3 is a rear partial perspective view of a lens of the key/display assembly of FIG. 1.
Figure 4:
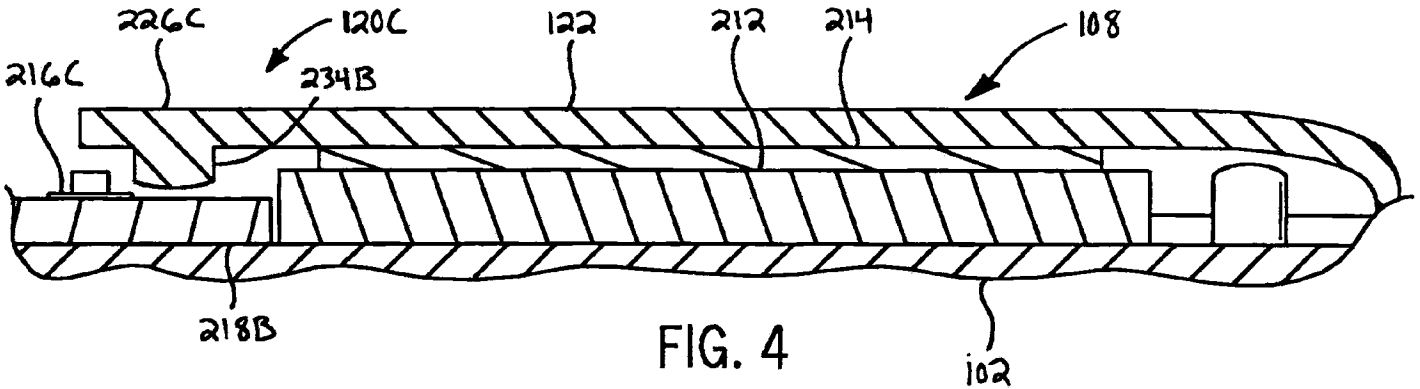
FIG. 4 is a section view of the key/display assembly along line 4-4 of FIG. 1.
Figure 5:
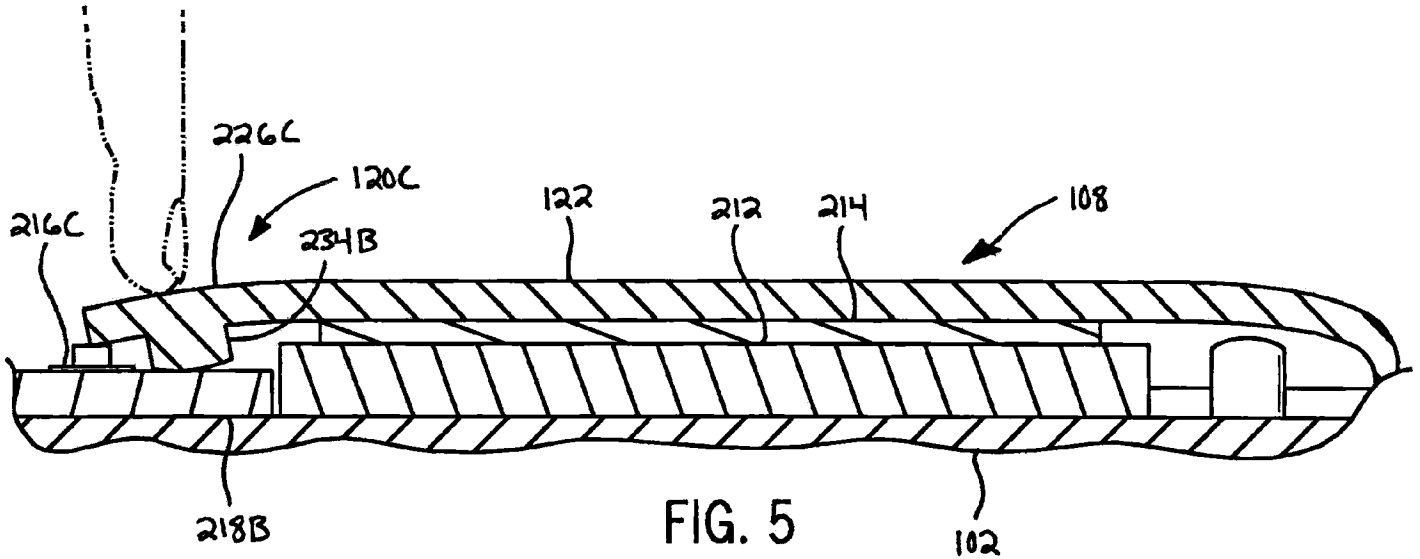
FIG. 5 is a section view of the key/display assembly along line 4-4 of FIG. 1 showing deflection of a menu key.

As shown most clearly in FIG. 3, the first and second feet 234A, 234B each have a shape that is generally elongated in a direction extending between the keypad 104 and the display module 212. The first and second feet 234A, 234B each also have a six-sided polygonal cross-sectional shape that is thicker near the inner surface 332 of the lens 122. Feet having other constructions may alternatively be used without departing from the scope of the disclosure.

Regardless of the specific shape that is used, the first foot 234A is disposed between the first contact region 226A and the second contact region 226B. As such, when the user deflects the first contact region 226A to actuate the first switch 216A (i.e., actuates the first key 120A), the first foot 234A contacts the first light guide 218A to inhibit the second contact region 226B from actuating the second switch 216B. Conversely, when the user deflects the second contact region 226B to actuate the second switch 216B, the first foot 234A contacts the first light guide 218A to inhibit the first contact region 226A from actuating the first switch 216A.

Figure 6:
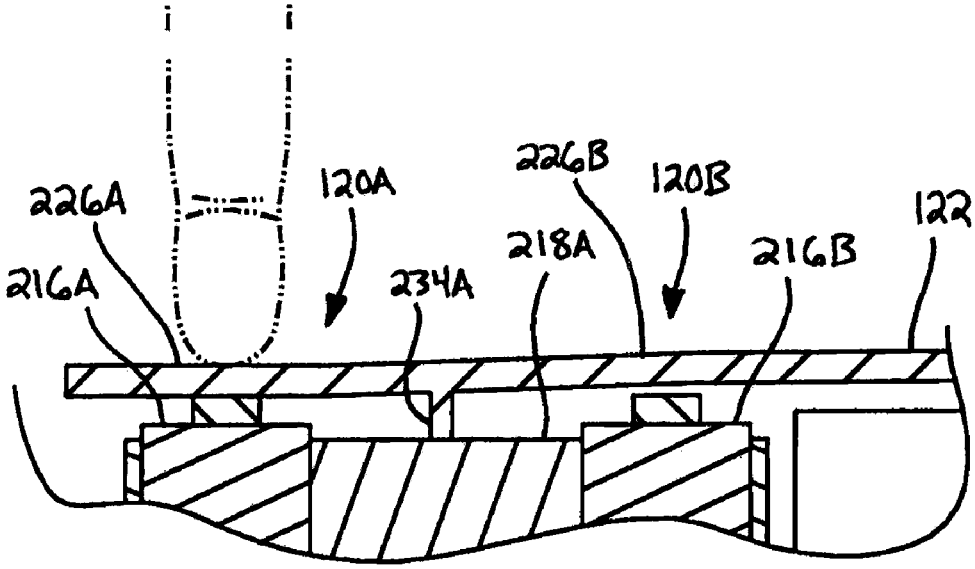
FIG. 6 is a section view of the key/display assembly along line 6-6 of FIG. 1 showing deflection of a first menu key.
Figure 7:
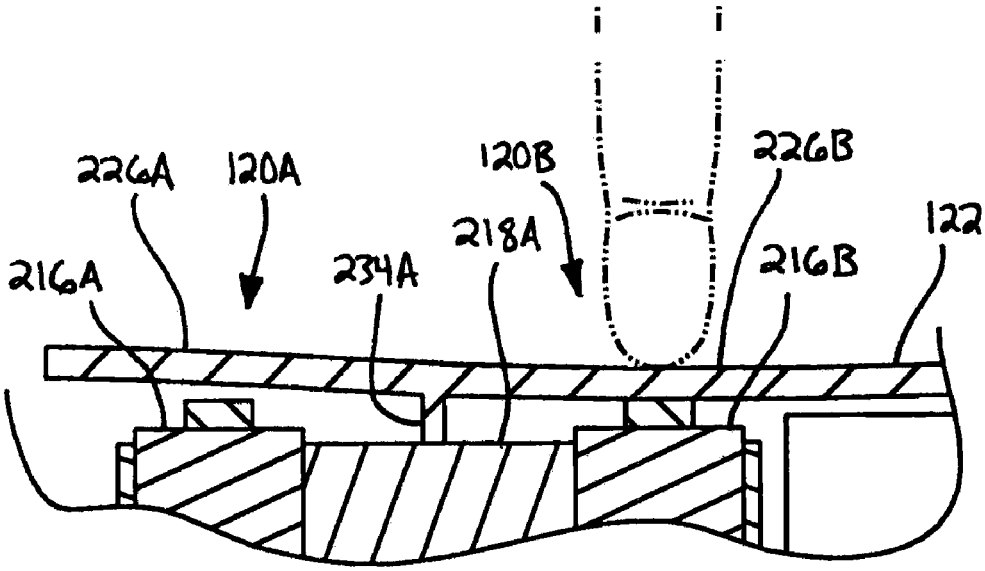
FIG. 7 is a section view of the key/display assembly along line 6-6 of FIG. 1 showing deflection of the second menu key.

In order to provide relatively low initial tactile feedback forces to the device user, the first foot 234A is normally spaced apart from the first light guide 218A by a small distance (e.g., approximately 0.2 mm). As such, the first and second contact regions 226A, 226B are deflectable over a first distance before the first foot 234A contacts the light guide 218A. After the first foot 234A contacts the first light guide 218A, the pressed contact region 226A or 226B may be further pressed and deflected over a second distance (e.g., approximately 0.2 mm) to actuate the associated switch 216A or 216B. However, the unpressed contact region 226A or 226B moves slightly away from the other switch 216A or 216B due to the "see-saw" structure of the first deflectable portion 224A and the first foot 234A. In particular and as shown most clearly in FIG. 6, the second contact region 226B moves away from the second switch 216B when the first contact region 226A deflects to actuate the first switch 216A. Conversely and as shown most clearly in FIG. 7, the first contact region 226A moves away from the first switch 216A when the second contact region 226B deflects to actuate the second switch 216B.

The second foot 234B is disposed between the third contact region 226C and the fourth contact region 226D but otherwise acts in a similar manner to the first foot 234A. In particular, when the user deflects the third contact region 226C to actuate the third switch 216C (i.e., actuates the third key 120C), the second foot 234B contacts the second light guide 218B to inhibit the fourth contact region 226D from actuating the fourth switch 216D. Conversely, when the user deflects the fourth contact region 226D to actuate the fourth switch 216D, the second foot 234B contacts the second light guide 218B to inhibit the third contact region 226C from actuating the third switch 216C.

In order to provide relatively low initial tactile feedback forces to the device user, the second foot 234B is normally spaced apart from the second light guide 218B by a small distance (e.g., approximately 0.2 mm). As such, the third and fourth contact regions 226C, 226D are deflectable over a first distance before the second foot 234B contacts the light guide 218B. After the second foot 234B contacts the second light guide 218B, the pressed contact region 226C or 226D may be further pressed and deflected over a second distance (e.g., approximately 0.2 mm) to actuate the associated switch 216C or 216D. However, the unpressed contact region 226C or 226D moves slightly away from the other switch 216C or 216D due to the "see-saw" structure of the second deflectable portion 224B and the second foot 234B. In particular, the fourth contact region 226D moves away from the fourth switch 216D when the third contact region 226C deflects to actuate the third switch 216C. Conversely, the third contact region 226C moves away from the third switch 216C when the fourth contact region 226D deflects to actuate the fourth switch 216D.

In addition to the features described above, the lens 122 further includes in-mold decorative features that identify the menu keys 120A-D. In particular, the in-mold decorative features include invariant indicia (i.e., invariant text characters, such as letters, numbers, punctuation, and symbols, and invariant functional characters, such as shift, enter, delete, menu, back, place call, end call, 'sym', and 'alt') aligned with the contact regions 226A-D and corresponding to the functions of the menu keys 120A-D. For example, the indicia includes a telephone-shaped functional character aligned with the first contact region 226A and corresponding to the "place call" function of the first key 120A.

As used herein, the term "invariant", when used to describe indicia, means that the text and/or functional character of a key does not change to other text and functional characters. However, the function performed by pressing such a key may vary depending on the operating mode of the electronic mobile device (e.g., if placing a phone call, sending a text message, playing a game, etc.). Furthermore, invariant indicia may be transparent or translucent and may be illuminated by light directed from the light guides 218A, 218B depending on the operating mode of the electronic mobile device (e.g., upon sensing low-light conditions). In addition, it is noted that the indicia are not limited to "invariant" indicia, but could also include variant indicia that changes based on the application, using such technology as e-ink, for example and as known in the art.

The key/display assembly 108 described above may be modified in various manners without departing from the scope of the disclosure. For example, the embodiments described above do not include a falsing-inhibiting foot between the second and third contact regions 226B, 226C because the trackpad passageway 228 reduces the likelihood of falsing between these contact regions. In other embodiments, the optical trackpad 110 is omitted and a foot is disposed between the second and third contact regions 226B, 226C to inhibit switch falsing (not shown).

From the above description it should be apparent that the present disclosure provides an electronic mobile device that has an aesthetically pleasing external appearance due to a generally continuous protective lens. In addition, the key/display assembly has a structure that inhibits switch falsing while providing tactile feedback to the device user.

The various embodiments presented above are merely examples and are in no way meant to limit the scope of this disclosure. Variations of the embodiments described herein will be apparent to persons of ordinary skill in the art, such variations being within the intended scope of the present application. In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combinations would be readily apparent to persons skilled in the art upon review of the present application as a whole. The subject matter described herein and in the recited claims intends to cover and embrace all suitable changes in technology.

What is claimed is:

1. A key/display assembly, comprising:

a first switch and a second switch;

a display module disposed aside the first switch and the second switch;

a lens disposed adjacent the display module and having an inner surface facing the display module, and the lens including a first contact region adjacent the first switch and a second contact region adjacent the second switch;

a first foot supported by the inner surface and disposed between the first contact region and the second contact region;

a first key defined by the first switch and the first contact region such that the first key is actuated by deflecting the first contact region to actuate the first switch;

a second key defined by the second switch and the second contact region such that the second key is actuated by deflecting the second contact region to actuate the second switch; and wherein when the first contact region deflects to actuate the first switch, the first foot inhibits the second contact region from actuating the second switch, and when the second contact region deflects to actuate the second switch, the first foot inhibits the first contact region from actuating the first switch.

2. The key/display assembly of claim 1, wherein the second contact region moves away from the second switch when the first contact region deflects to actuate the first switch, and the first contact region moves away from the first switch when the second contact region deflects to actuate the second switch.

3. The key/display assembly of claim 1, further comprising a base supporting the first switch, the second switch, the display module, and the lens, and wherein when the first contact region deflects to actuate the first switch, the first foot contacts the base to inhibit the second contact region from actuating the second switch.

4. The key/display assembly of claim 3, wherein the first foot is normally disposed apart from the base and the first contact region is deflectable over a first distance in which the first foot does not contact the base, and when the first foot contacts the base, the first contact region is deflectable over a second distance to actuate the first switch.

5. The key/display assembly of claim 1, wherein the first contact region and the second contact region are cantilevered past an edge of the display module.

6. The key/display assembly of claim 1, further comprising a compressible gasket disposed between the display module and the lens and proximate an edge of the display module.

7. The key/display assembly of claim 6, wherein the compressible gasket supports the lens such that the first contact region and the second contact region are cantilevered past the edge of the display module.

8. The key/display assembly of claim 7, wherein the lens further includes a display region overlying the compressible gasket through which the display module is viewable.

9. The key/display assembly of claim 8, wherein the lens is continuous between the display region, the first contact region, and the second contact region.

10. The key/display assembly of claim 1, wherein the lens is continuous between the first contact region and the second contact region.

11. The key/display assembly of claim 1, wherein the lens further includes a display region through which the display module is viewable, and the lens is continuous between the display region, the first contact region, and the second contact region.

12. The key/display assembly of claim 1, further comprising:

a base supporting the first switch, the second switch, the display module, and the lens;

a third switch supported by the base;

a fourth switch supported by the base;

wherein the lens further includes a third contact region adjacent the third switch and a fourth contact region adjacent the fourth switch;

a second foot supported by the inner surface and disposed between the third contact region and the fourth contact region;

a third key defined by the third switch and the third contact region such that the third key is actuated by deflecting the third contact region to actuate the third switch;

a fourth key defined by the fourth switch and the fourth contact region such that the fourth key is actuated by deflecting the fourth contact region to actuate the fourth switch; and wherein when the third contact region deflects to actuate the third switch, the second foot contacts the base to inhibit the fourth contact region from actuating the fourth switch, and when the fourth contact region deflects to actuate the fourth switch, the second foot contacts the base to inhibit the third contact region from actuating the third switch.

13. The key/display assembly of claim 12, further comprising an input control supported by the base and disposed between the second switch and the third switch, and wherein the lens includes a passageway between the second contact region and the third contact region through which the input control extends.

14. The key/display assembly of claim 1, wherein the first foot integrally connects to the lens.

15. The key/display assembly of claim 1, wherein the first key further includes at least one of an invariant text character and an invariant functional character, and the second key further includes at least one of an invariant text character and an invariant functional character.

16. An electronic mobile device, comprising:

a base;

a first switch and a second switch supported by the base;

a display module supported by the base and disposed aside the first switch and the second switch;

a lens disposed adjacent the display module and having an inner surface facing the base, the lens including a first deflectable portion cantilevered past an edge of the display;

a first foot supported by the inner surface of the lens and normally disposed apart from the base;

a first key disposed to a first side of the first foot and including a first contact region of the first deflectable portion of the lens, the first key being actuated by deflecting the first contact region to actuate the first switch;

a second key disposed to a second side of the first foot and including a second contact region of the first deflectable portion of the lens, the second key being actuated by deflecting the second contact region to actuate the second switch; and wherein when the first key is actuated, the first foot contacts the base to inhibit the second contact region from actuating the second switch, and when the second key is actuated, the first foot contacts the base to inhibit the first contact region from actuating the first switch.

17. The electronic mobile device of claim 16, wherein the lens is continuous between the first contact region and the second contact region.

18. An electronic mobile device, comprising:

a base;

a first switch and a second switch supported by the base;

a display module supported by the base and disposed aside the first switch and the second switch;

a lens overlying the display module and including:

a first contact region adjacent the first switch;

a second contact region adjacent the second switch;

a first foot integrally supported between the first contact region and the second contact region and extending toward the base;

a first key defined by the first switch and the first contact region such that the first key is actuated by deflecting the first contact region to actuate the first switch;

a second key defined by the second switch and the second contact region such that the second key is actuated by deflecting the second contact region to actuate the second switch; and wherein when the first contact region deflects to actuate the first switch, the first foot contacts the base to inhibit the second contact region from actuating the second switch, and when the second contact region deflects to actuate the second switch, the first foot contacts the base to inhibit the first contact region from actuating the first switch.

19. The electronic mobile device of claim 18, wherein the first key further includes at least a first invariant character, and the second key further includes at least a second invariant character.

20. The electronic mobile device of claim 19, wherein the base includes a light guide that directs light to thereby illuminate the first invariant character and the second invariant character, upon deflecting the first contact region to actuate the first switch, the first foot contacts the light guide to inhibit the second contact region from actuating the second switch, and upon deflecting the second contact region to actuate the second switch, the first foot contacts the light guide to inhibit the first contact region from actuating the first switch.

* * * * *